US007448246B2

(12) United States Patent
Briese et al.

(10) Patent No.: US 7,448,246 B2
(45) Date of Patent: Nov. 11, 2008

(54) WINDOW FRAME CORNER FABRICATION

(75) Inventors: William A. Briese, Hinckley, OH (US); Robert S. Galosi, Willoughby, OH (US); John Grismer, Cuyahoga Falls, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 227 days.

(21) Appl. No.: 11/416,304

(22) Filed: May 2, 2006

(65) Prior Publication Data

US 2007/0261247 A1 Nov. 15, 2007

(51) Int. Cl.
*B21D 28/30* (2006.01)

(52) U.S. Cl. ..... 72/335; 72/177; 72/181; 72/379.2

(58) Field of Classification Search ..... 72/335, 72/129, 131, 181, 379.2, 177, 179, 180, 334; 29/897.3, 897.312
See application file for complete search history.

(56) References Cited

U.S. PATENT DOCUMENTS 3,478,483 A * 11/1969 Baker ..... 52/658
3,911,554 A * 10/1975 Ford ..... 29/527.2
4,574,553 A * 3/1986 Lisec ..... 52/658
4,597,232 A 7/1986 Lingemann
5,255,481 A 10/1993 Misera et al.
5,361,476 A 11/1994 Leopold
5,501,013 A * 3/1996 Misera et al. ..... 29/897.312
5,531,047 A * 7/1996 Leopold et al. ..... 52/172
5,617,699 A * 4/1997 Thompson, Jr. ..... 52/786.13
6,360,420 B2 * 3/2002 Shah et al. ..... 29/458
6,405,498 B1 6/2002 Riegelman et al.

FOREIGN PATENT DOCUMENTS

DE 3246988 * 6/1984

* cited by examiner

*Primary Examiner*—Derris H. Banks
*Assistant Examiner*—Debra M Wolfe
(74) *Attorney, Agent, or Firm*—Tarolli, Sundheim, Covell & Tummino LLP

(57) ABSTRACT

Method and Apparatus for fabricating a spacer frame for use in an insulating glass unit. A roll former bends a strip of material to form a spacer frame having side walls to which an adhesive is applied during fabrication of an insulated glass unit. Alternately a plastic frame is formed by extrusion. A notching apparatus forms notches at locations that extend into the side walls to weaken the side walls for bending of said elongated channel into a closed structure. A downstream workstation predisposes specified locations of the sidewalls to facilitate bending of the spacer frame. The workstation forces the specified locations of the sidewalls inwardly toward each other at the predetermined bend locations.

11 Claims, 10 Drawing Sheets

50
52
52
312

50
498
499
312

372
378
452
370
378
452
466
470
462
460
360
362
450
464

WINDOW FRAME CORNER FABRICATION

FIELD OF THE INVENTION

The present invention relates to insulating glass units and more particularly to a method and apparatus for fabricating a spacer frame for use in making a window.

BACKGROUND OF THE INVENTION

Insulating glass units (IGUs) are used in windows to reduce heat loss from building interiors during cold weather. IGUs are typically formed by a spacer assembly sandwiched between glass lites. A spacer assembly usually comprises a frame structure extending peripherally about the unit, a sealant material adhered both to the glass lites and the frame structure, and a desiccant for absorbing atmospheric moisture within the unit. The margins or the glass lites are flush with or extend slightly outwardly from the spacer assembly. The sealant extends continuously about the frame structure periphery and its opposite sides so that the space within the IGUs is hermetic.

There have been numerous proposals for constructing IGUs. One type of IGU was constructed from an elongated corrugated sheet metal strip-like frame embedded in a body of hot melt sealant material. Desiccant was also embedded in the sealant. The resulting composite spacer was packaged for transport and storage by coiling it into drum-like containers. When fabricating an IGU the composite spacer was partially uncoiled and cut to length. The spacer was then bent into a rectangular shape and sandwiched between conforming glass lites.

Perhaps the most successful IGU construction has employed tubular, roll formed aluminum or steel frame elements connected at their ends to form a square or rectangular spacer frame. The frame sides and corners were covered with sealant (e.g., a hot melt material) for securing the frame to the glass lites. The sealant provided a barrier between atmospheric air and the IGU interior which blocked entry of atmospheric water vapor. Particulate desiccant deposited inside the tubular frame elements communicated with air trapped in the IGU interior to remove the entrapped airborne water vapor and thus preclude its condensation within the unit. Thus after the water vapor entrapped in the IGU was removed internal condensation only occurred when the unit failed.

In some cases the sheet metal was roll formed into a continuous tube, with desiccant inserted, and fed to cutting stations where "V" shaped notches were cut in the tube at corner locations. The tube was then cut to length and bent into an appropriate frame shape. The continuous spacer frame, with an appropriate sealant in place, was then assembled in an IGU.

Alternatively, individual roll formed spacer frame tubes were cut to length and "corner keys" were inserted between adjacent frame element ends to form the corners. In some constructions the corner keys were foldable so that the sealant could be extruded onto the frame sides as the frame moved linearly past a sealant extrusion station. The frame was then folded to a rectangular configuration with the sealant in place on the opposite sides. The spacer assembly thus formed was placed between glass lites and the IGU assembly completed.

IGUs have failed because atmospheric water vapor infiltrated the sealant barrier. Infiltration tended to occur at the frame corners because the opposite frame sides were at least partly discontinuous there. For example, frames where the corners were formed by cutting "V" shaped notches at corner locations in a single long tube. The notches enabled bending the tube to form mitered corner joints; but afterwards potential infiltration paths extended along the corner parting lines substantially across the opposite frame faces at each corner.

Likewise in IGUs employing corner keys, potential infiltration paths were formed by the junctures of the keys and frame elements. Furthermore, when such frames were folded into their final forms with sealant applied, the amount of sealant at the frame corners tended to be less than the amount deposited along the frame sides. Reduced sealant at the frame corners tended to cause vapor leakage paths.

In all these proposals the frame elements had to be cut to length in one way or another and, in the case of frames connected together by corner keys, the keys were installed before applying the sealant. These were all manual operations which limited production rates. Accordingly, fabricating IGUs from these frames entailed generating appreciable amounts of scrap and performing inefficient manual operations.

In spacer frame constructions where the roll forming occurred immediately before the spacer assembly was completed, sawing, desiccant filling and frame element end plugging operations had to be performed by hand which greatly slowed production of units.

U.S. Pat. No. 5,361,476 to Leopold discloses a method and apparatus for making IGUs wherein a thin flat strip of sheet material is continuously formed into a channel shaped spacer frame having corner structures and end structures, the spacer thus formed is cut off, sealant and desiccant are applied and the assemblage is bent to form a spacer assembly.

SUMMARY OF THE INVENTION

An exemplary system fabricates a spacer frame for use in an insulating glass unit and includes forming structure for forming an elongated channel having side walls to which an adhesive is applied during fabrication of an insulated glass unit. A notching apparatus forms notches at locations that extend into the side walls to weaken the side walls for bending of the elongated channel into a closed structure. An additional workstation predisposes weakened portions of the sidewalls to facilitate bending of the spacer frame. This additional workstation causes the weakened portions of the sidewalls to extend inwardly toward each other.

One exemplary embodiment of the additional workstation is a crimping station that gives a rollformed frame member corners with an inward tendency while allowing a lighter hit from corner form tooling prior to the rollformer. This is achieved through the use of two pointed fingers mounted to a crimper assembly at a discharge side of the rollformer, prior to frame cutoff from the strip material from which the frame is formed. To place the crimp in the proper location the fingers move at the same rate of speed as the frame. A roller rides on top of the spacer and when a corner or lead passes under the roller, the roller drops into a cut out notch of the spacer frame. Once the roller is in the corner or lead, the roller drags the crimper assembly along with the spacer while the fingers place the crimp in the corner or lead. After the crimp has been made the fingers and roller retract away from the spacer and a spring returns the crimper assembly back to a home or start position. If the corner or lead is left uncrimped there is a risk that outward folding of the side wall can occur. This will cause a defective IGU and the ultimate life of the finished IGU will be compromised. These and other objects advantages and features of the invention will become more fully understood from the detailed description of an exemplary embodiment of the invention which is described in conjunction with the accompanying drawings.

EXEMPLARY EMBODIMENT OF THE INVENTION

Figure 1:
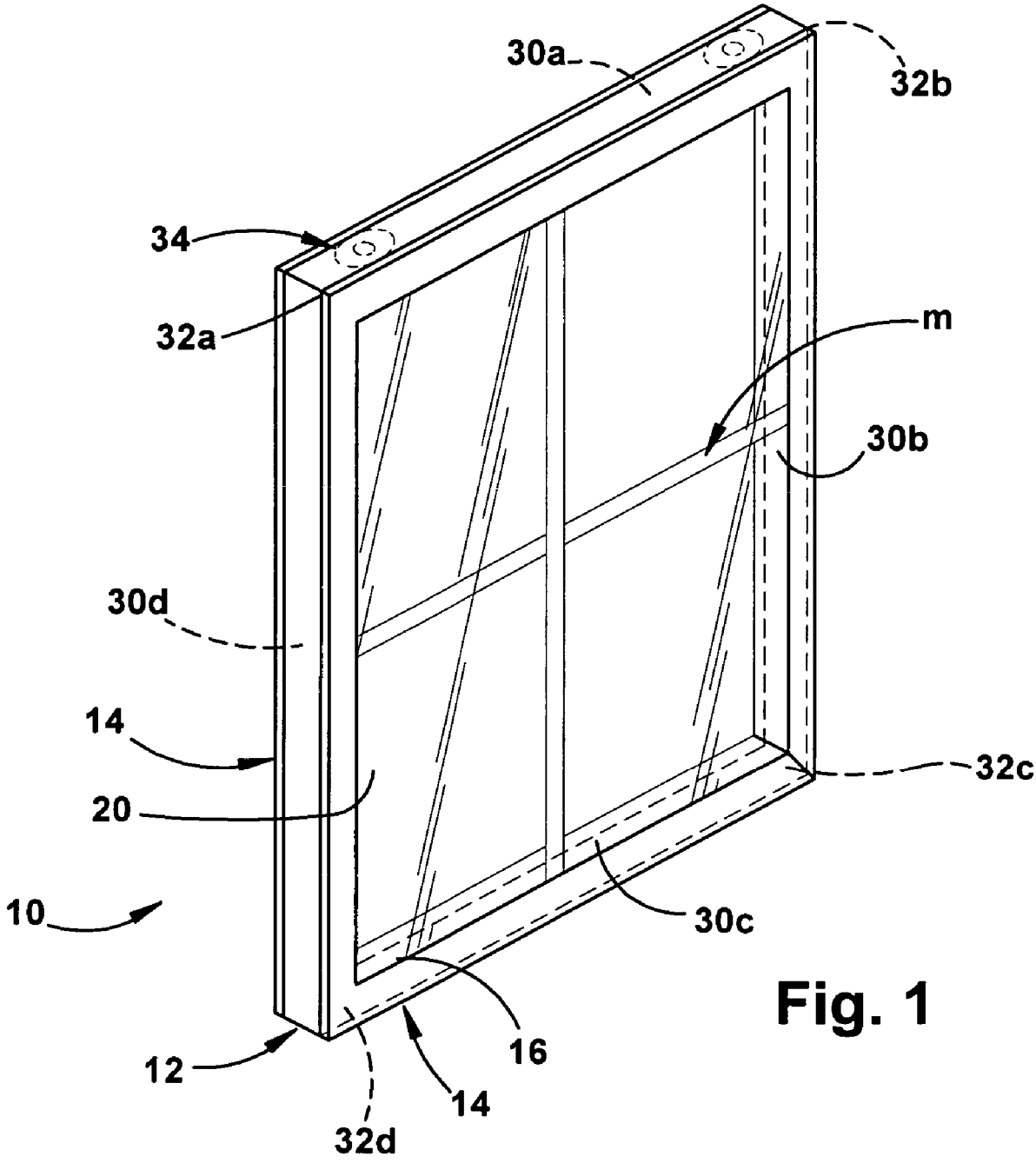
FIG. 1 is a perspective view of an insulating glass unit.

The drawing Figures and specification disclose a method and apparatus for producing elongated spacer frames used in making insulating glass units. The method and apparatus are embodied in a production line which forms material into spacer frames for completing the construction of insulating glass units. While an exemplary system fabricates metal frames, the invention can be used with plastic frame material extruded into elongated sections having corner notches.

An insulating glass unit (IGU) 10 is illustrated in FIG. 1. The IGU includes a spacer assembly 12 sandwiched between glass sheets, or lites, 14. The assembly 12 comprises a frame structure 16 and sealant material for hermetically joining the frame to the lites to form a closed space 20 within the unit 10. The unit 10 is illustrated in FIG. 1 as in condition for final assembly into a window or door frame, not illustrated, for ultimate installation in a building. The unit 10 illustrated in FIG. 1 includes muntin bars that provide the appearance of individual window panes.

The assembly 12 maintains the lites 14 spaced apart from each other to produce the hermetic insulating "insulating air space" 20 between them. The frame 16 and the sealant body 18 co-act to provide a structure which maintains the lites 14 properly assembled with the space 20 sealed from atmospheric moisture over long time periods during which the unit 10 is subjected to frequent significant thermal stresses. A desiccant removes water vapor from air, or other volatiles, entrapped in the space 20 during construction of the unit 10.

The sealant both structurally adheres the lites 14 to the spacer assembly 12 and hermetically closes the space 20 against infiltration of airborne water vapor from the atmosphere surrounding the unit 10. One suitable sealant is formed from a "hot melt" material which is attached to the frame sides and outer periphery to form a U-shaped cross section.

Figure 2:
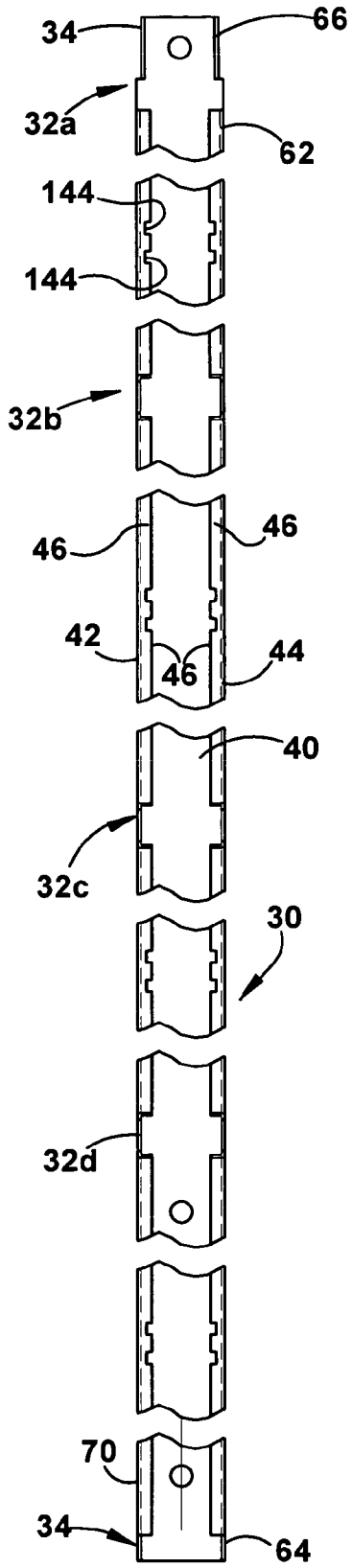
FIGS. 2 and 3 are top and side views of a spacer frame that forms part of the FIG. 1 insulating glass unit.
Figure 3:
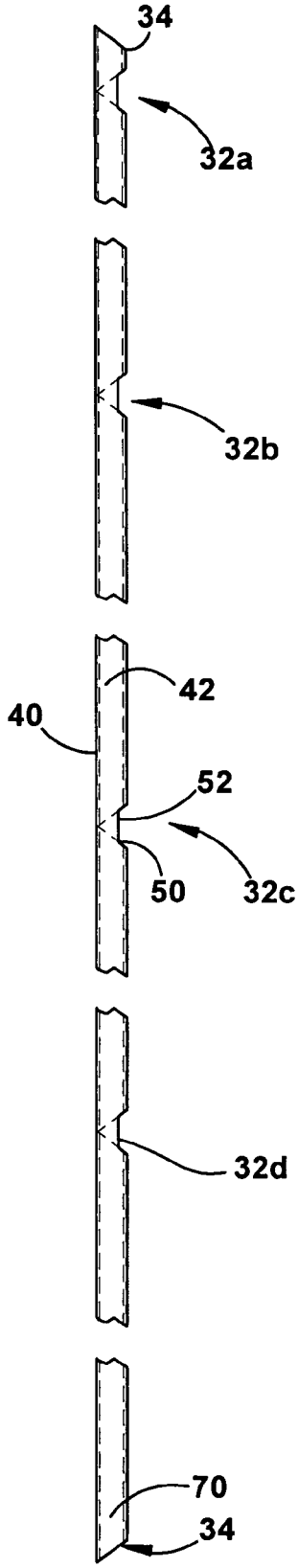

The frame 16 extends about the unit periphery to provide a structurally strong, stable spacer for maintaining the lites aligned and spaced while minimizing heat conduction between the lites via the frame. The preferred frame 16 comprises a plurality of spacer frame segments, or members, 30*a-d* connected to form a planar, polygonal frame shape, element juncture forming frame corner structures 32*a-d*, and connecting structure 34 (FIG. 2) for joining opposite frame element ends to complete the closed frame shape.

Each frame member 30 is elongated and has a channel shaped cross section defining a peripheral wall 40 and first and second lateral walls 42, 44. See FIG. 2. The peripheral wall 40 extends continuously about the unit 10 except where the connecting structure 34 joins the frame member ends. The lateral walls 42, 44 are integral with respective opposite peripheral wall edges. The lateral walls extend inwardly from the peripheral wall 40 in a direction parallel to the planes of the lites and the frame. The illustrated frame 16 has stiffening flanges 46 formed along the inwardly projecting lateral wall edges. The lateral walls 42, 44 add rigidity the frame member 30 so it resists flexure and bending in a direction transverse to its longitudinal extent. The flanges 46 stiffen the walls 42, 44 so they resist bending and flexure transverse to their longitudinal extents.

The frame is initially formed as a continuous straight channel constructed from a thin ribbon of stainless steel material (e.g., 304 stainless steel having a thickness of 0.006-0.010 inches). Other materials, such as galvanized, tin plated steel, aluminum or plastic, may also be used to construct the channel. As described more fully below, the corner structures 32 are made to facilitate bending the frame channel to the final, polygonal frame configuration in the unit 10 while assuring an effective vapor seal at the frame corners. A sealant is applied and adhered to the channel before the corners are bent. The corner structures 32 initially comprise notches 50 and weakened zones 52 formed in the walls 42, 44 at frame corner locations. See FIGS. 3-6. The notches 50 extend into the walls 42, 44 from the respective lateral wall edges. The lateral walls 42, 44 extend continuously along the frame 16 from one end to the other. The walls 42, 44 are weakened at the corner locations because the notches reduce the amount of lateral wall material and eliminate the stiffening flanges 46 and because the walls are stamped to weaken them at the corners.

At the same time the notches 50 are formed, the weakened zones 52 are formed. These weakened zones are cut into the strip, but not all the way through. When this strip is roll-formed, the weakened zones can spring back and have an outward tendency.

The connecting structure 34 secures the opposite frame ends 62, 64 together when the frame has been bent to its final configuration. The illustrated connecting structure comprises a connecting tongue structure 66 continuous with and projecting from the frame structure end 62 and a tongue receiving structure 70 at the other frame end 64. The preferred tongue and tongue receiving structures 66, 70 are constructed and sized relative to each other to form a telescopic joint. When assembled, the telescopic joint 72 maintains the frame in its final polygonal configuration prior to assembly of the unit 10.

The Production Line 100

Figure 4:
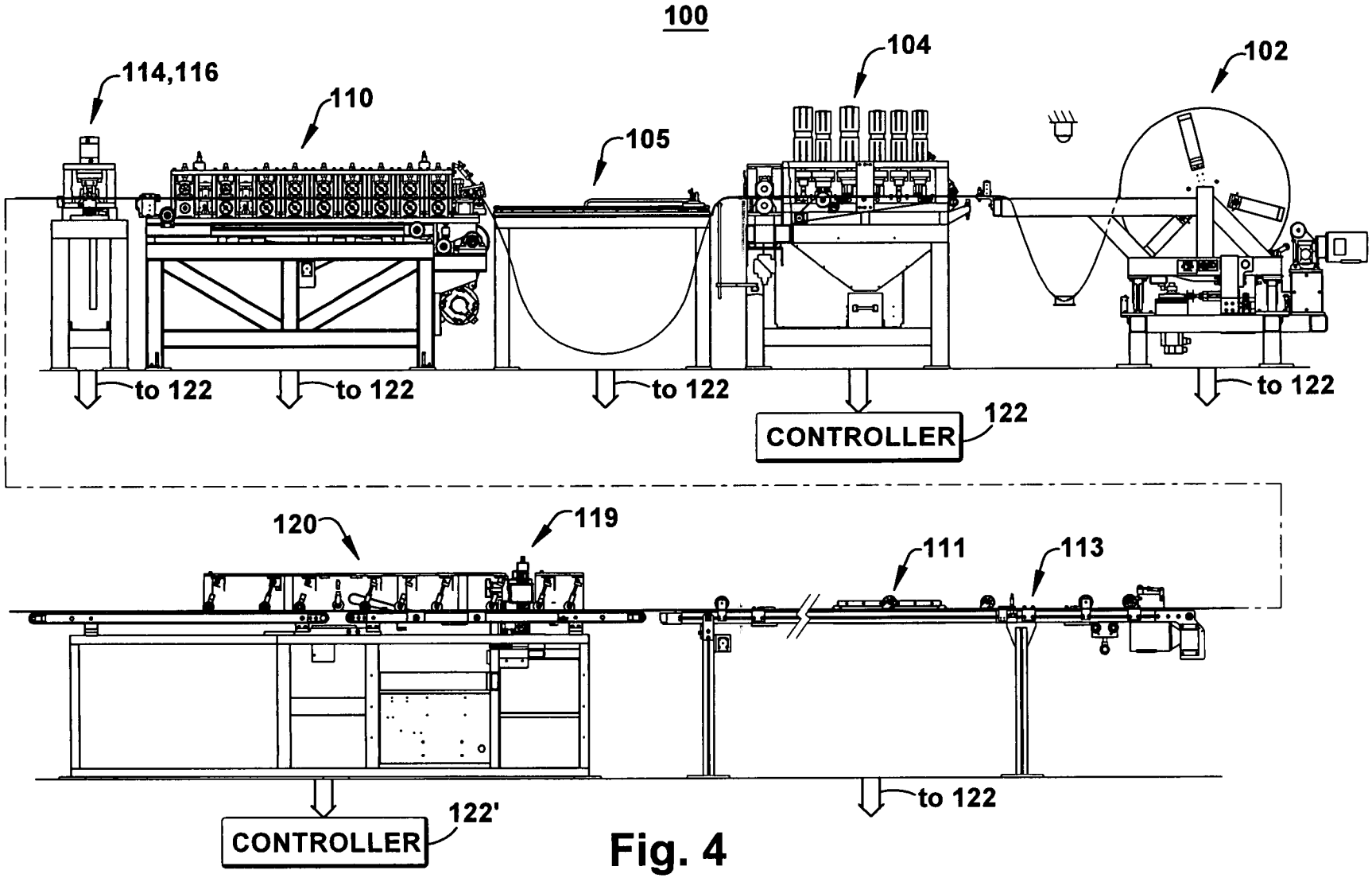
FIG. 4 is a schematic depiction of a production line for use with the invention.

As indicated previously the spacer assemblies 12 are elongated window components that may be fabricated by using the method and apparatus of the present invention. Elongated window components are formed at high rates of production. The operation by which elongated window components are fashioned is schematically illustrated in FIG. 4 as a production line 100 through which a thin, relatively narrow ribbon of sheet metal stock is fed endwise from a coil into one end of the assembly line and substantially completed elongated window components 8 emerge from the other end of the line 100.

The line 100 comprises a stock supply station 102, a first forming station 104, a transfer mechanism 105, a second forming station 110, a conveyor 113, a scrap removal apparatus 111, third and fourth forming stations 114, 116, respectively, where partially formed spacer members are separated from the leading end of the stock and frame corner locations are deformed preparatory to being folded into their final configurations, a desiccant application station 119 where desiccant is applied to an interior region of the spacer frame member, and an extrusion station 120 where sealant is applied to the yet to be folded frame member. A scheduler/motion controller unit 122 interacts with the stations and loop feed sensors to govern the spacer stock size, spacer assembly size, the stock feeding speeds in the line, and other parameters involved in production. A preferred controller unit 122 is commercially available from Delta Tau, 21314 Lassen St, Chatsworth, Calif. 91311 as part number UMAC.

The Roll Former 210

Figure 5:
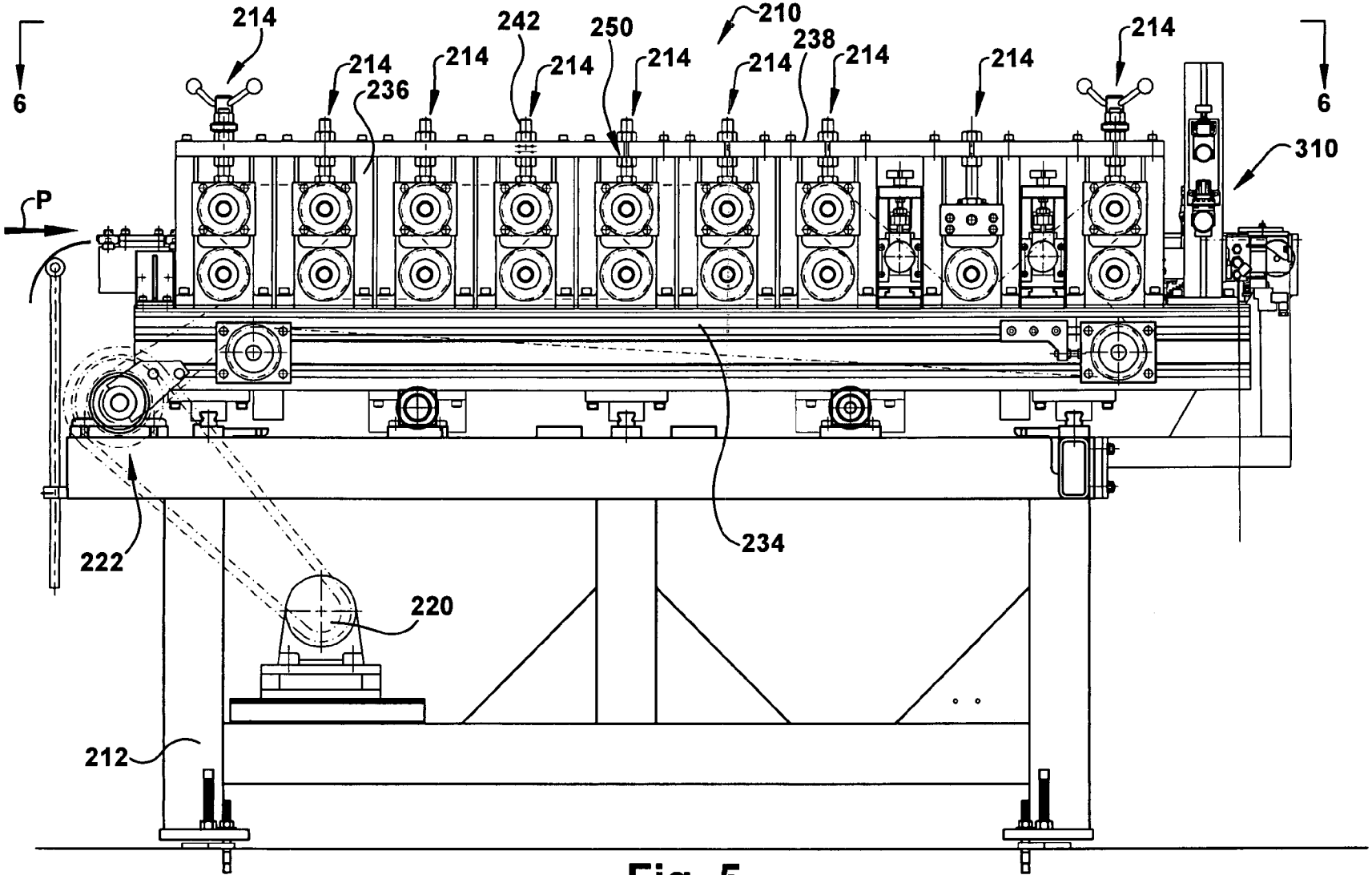
FIGS. 5 and 6 depict roll forming apparatus for use with the invention.
Figure 6:
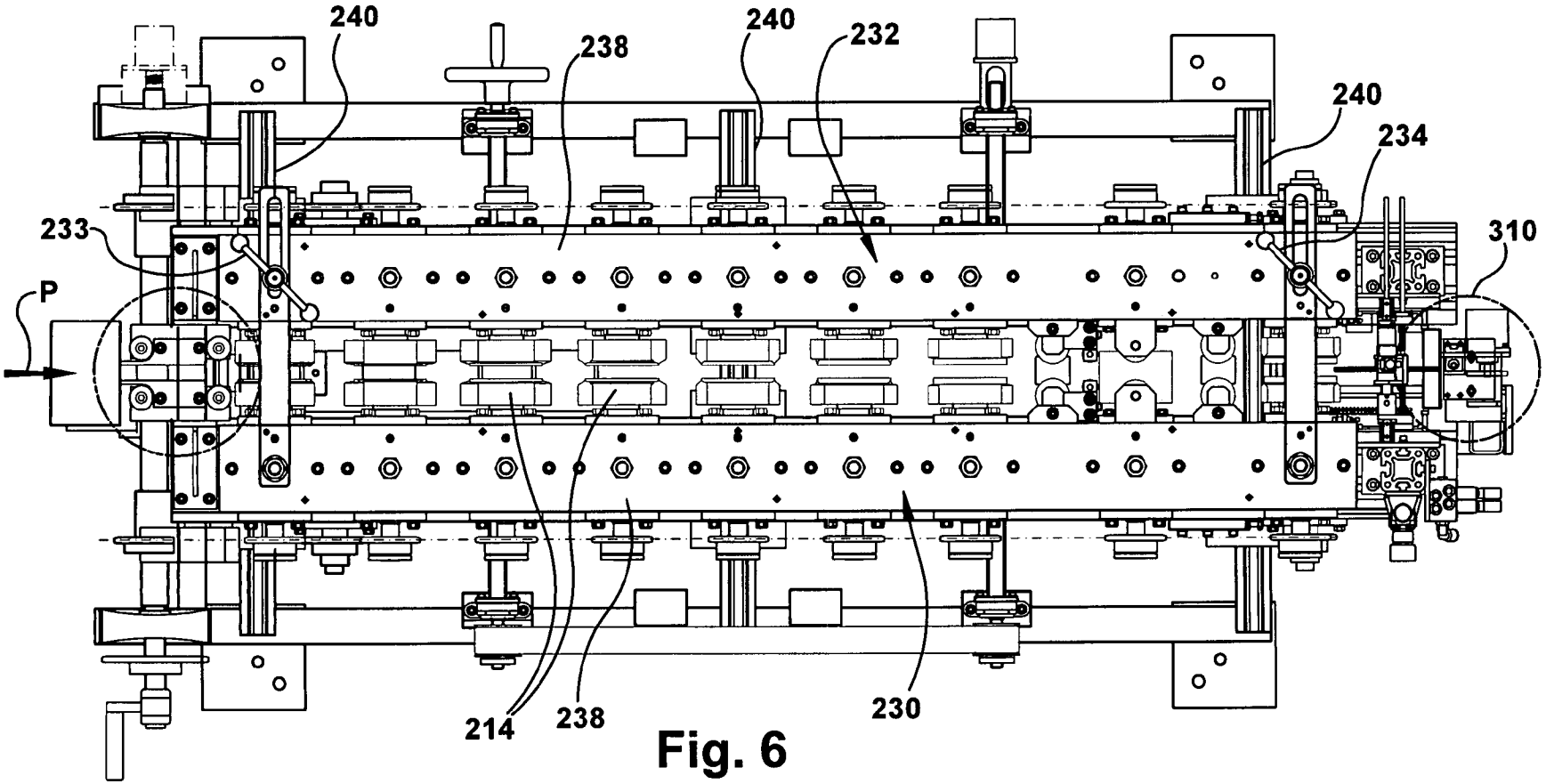
Figure 7:
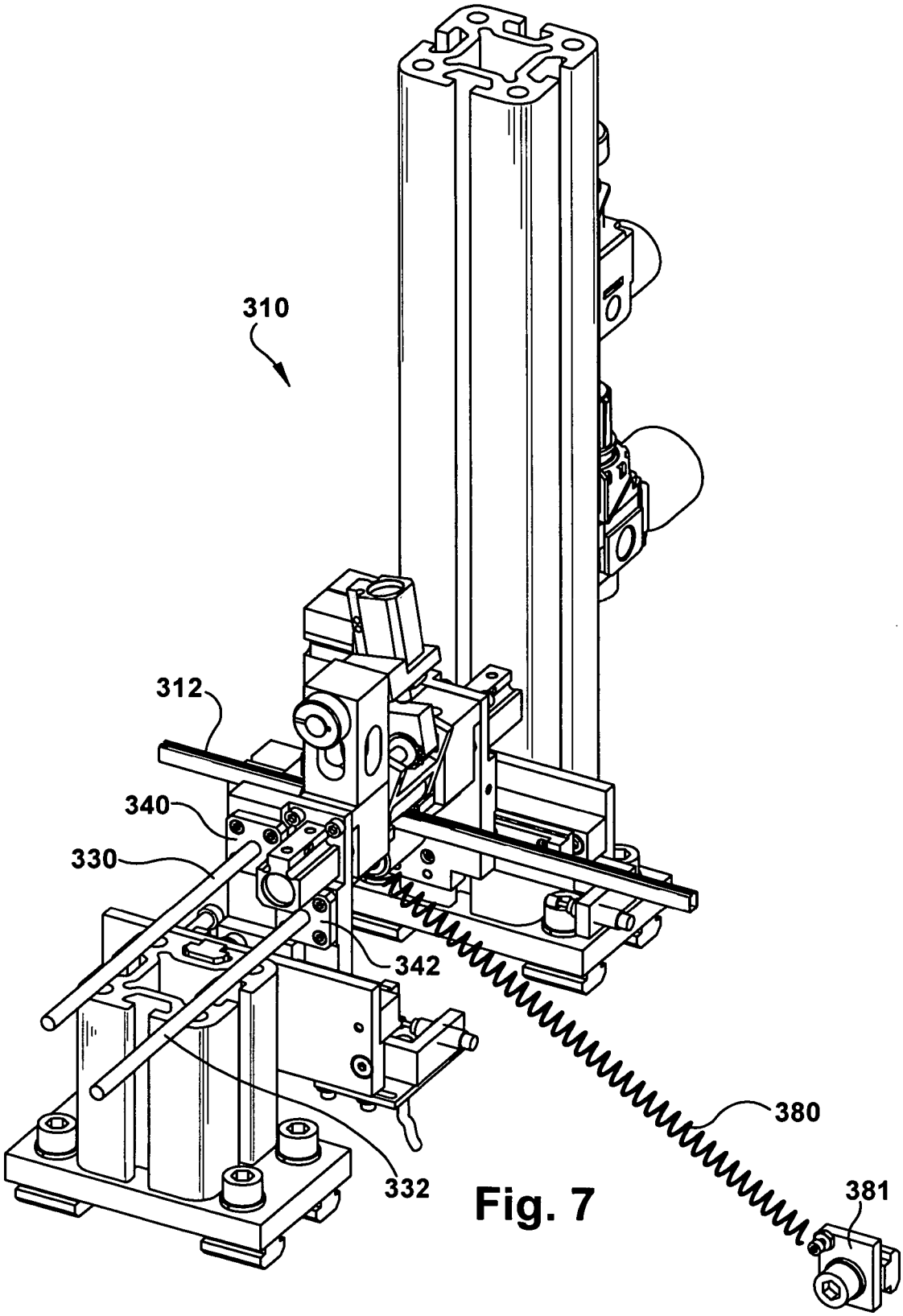
FIG. 7 is a perspective view of a crimping assembly.

Referring to FIGS. 5 and 6, the forming station 210 is preferably a rolling mill comprising a support frame structure 212, roll assemblies 214 carried by the frame structure 212, a roll assembly drive motor 220, a drive transmission 222 (FIG. 5 ) coupling the drive motor 220 to the roll assemblies, and a system enabling the station 210 to roll form stock having different widths.

The support frame structure 212 comprises a base fixed to the floor and first and second roll supporting frame assemblies mounted atop the frame structure. The base positions the frame assembly 224 in line with the stock path of travel P immediately adjacent a transfer mechanism, such that a fixed stock side location of a stamping station that cuts notches at corner locations is aligned with a fixed stock side location of the roll forming station 210.

Referring to FIG. 6, the roll supporting frame assemblies include a fixed roll support unit 230 and a moveable roll support unit 232 respectively disposed on opposite sides of the path of travel P. The units 230, 232 are generally mirror images, with the exception that unit 232 is moveable and unit 230 is fixed. Components that allow unit 232 to move are not included in unit 230. Each of the units 230, 232 comprises a lower support beam 234 extending the full length of the mill, a series of spaced apart vertical upwardly extending stanchions 236 fixed to the lower beam 234, one pair of vertically aligned mill rolls received between each successive pair of the stanchions 236, and an upper support bar 238 fixed to the upper ends of the stanchions.

Each mill roll pair extends between a respective pair of stanchions 236 so that the stanchions provide support against relative mill roll movement in the direction of extent of the path of travel P as well as securing the rolls together for assuring adequate engagement pressure between rolls and the stock passing through the roll nips. The support beam 238 carries three spaced apart linear bearing assemblies 240 on its lower side. Each linear bearing is aligned with and engages a respective trackway so that the beam 238 may move laterally toward and away from the stock path of travel P on the trackways.

Each roll assembly 214 is formed by two roll pairs aligned with each other on the path of stock travel to define a single "pass" of the rolling mill. That is to say, the rolls of each pair have parallel axes disposed in a common vertical plane and with the upper rolls of each pair and the lower rolls of each pair being coaxial. The rolls of each pair project laterally towards the path of stock travel from their respective support units 230, 232. The projecting roll pair ends are adjacent each other with each pair of rolls constructed to perform the same operation on opposite edges of the ribbon stock. The nip of each roll pair is spaced laterally away from the center line of the travel path. The roll pairs of each assembly are thus laterally separated along the path of travel.

The upper support bar 238 carries a nut and screw force adjuster 250 associated with each upper mill roll for adjustably changing the engagement pressure exerted on the stock at the roll nip. The adjuster 240 comprises a screw 242 threaded into the upper roll bearing housing and lock nuts for locking the screw in adjusted positions. The adjusting screw is thus rotated to positively adjust the upper roll position relative to the lower roll. The beam 484 fixedly supports the lower mill roll of each pair. The adjusters 240 enable the vertically adjustable mill rolls to be moved towards or away from the fixed mill rolls to increase or decrease the force with which the roll assemblies engage the stock passing between them.

The drive motor 220 is preferably an electric servomotor driven from the controller unit 122. As such the motor speed can be continuously varied through a wide range of speeds without appreciable torque variations.

Whenever the motor 220 is driven, the rolls of each roll assembly are positively driven in unison at precisely the same angular velocity. The roll sprockets of successive roll pairs are identical and there is no slip in the chains so that the angular velocity of each roll in the rolling mill is the same as that of each of the others. The slight difference in roll diameter provides for the differences in roll surface speed referred to above for tensioning the stock without distorting it.

In the exemplary embodiment, the distance between the units 230, 232 is manually adjusted to adapt the roll forming station 210 to the width of sheet stock to be presented to roll forming station 210. Two adjustable hold down members 233, 234 are loosened and the unit 232 shifts the moveable rolls laterally towards and away from the fixed roll of each roll assembly so that the stock passing through the rolling mill can be formed into spacer frame members having different widths. The drive transmission 222 is preferably a timing belt reeved around sheaves on the drivescrews.

Crimper Assembly 310

A Crimper Assembly 310 is connected to an output end of the roll former 210 and processes a strip 312 of steel that has been bent by the roll former 210. The crimper assembly has two movable carriages 314, 316 that are coupled to linear bearings 320, 322 which move along spaced apart generally parallel tracks or guides 324, 326 that extend along the exit side of the roll former 210.

The carriages 314, 316 are connected by first and second horizontally extending rods 330, 332 that pass through openings in the carriages 314, 316. The rods are anchored to one carriage 316 and on an opposite side of the path of travel the rods pass through bearings 340, 342 supported by the carriage 314. This arrangement allows the spacer frame width created by the rollformer to be varied with only minor adjustments to the Crimper Assembly 310.

A first steel roller 344 mounted on the lower rod 332 supports the spacer frame 312 as it exits the roll former 210. Springs (not shown) engage ends of this roller and are compressed between two side plates 350, 352 and the roller. This arrangement keeps the roller centered regardless of the spacer size being formed. The height of the crimper assembly 310 in relation to the roll former is adjusted so that the lower roller just touches the bottom of the spacer frame as the spacer frame exits the roll former.

Pivotally mounted on the upper rod is a yoke 454 which supports an upper roller 356. The yoke pivots on the upper rod. The upper roller is directly above the lower roller. An air cylinder 360 is mounted to the yoke 454. The amount of force the cylinder 360 applies to the upper roller is controlled by a precision regulator. If the cylinder does not apply enough pressure on the roller, the roller will not engage the spacer frame corners and leads firmly enough and the crimp will be late or nonexistent. If the cylinder force is too high, the roller will lock into the front of the lead and the crimp will not be in the desired location.

Figure 8:
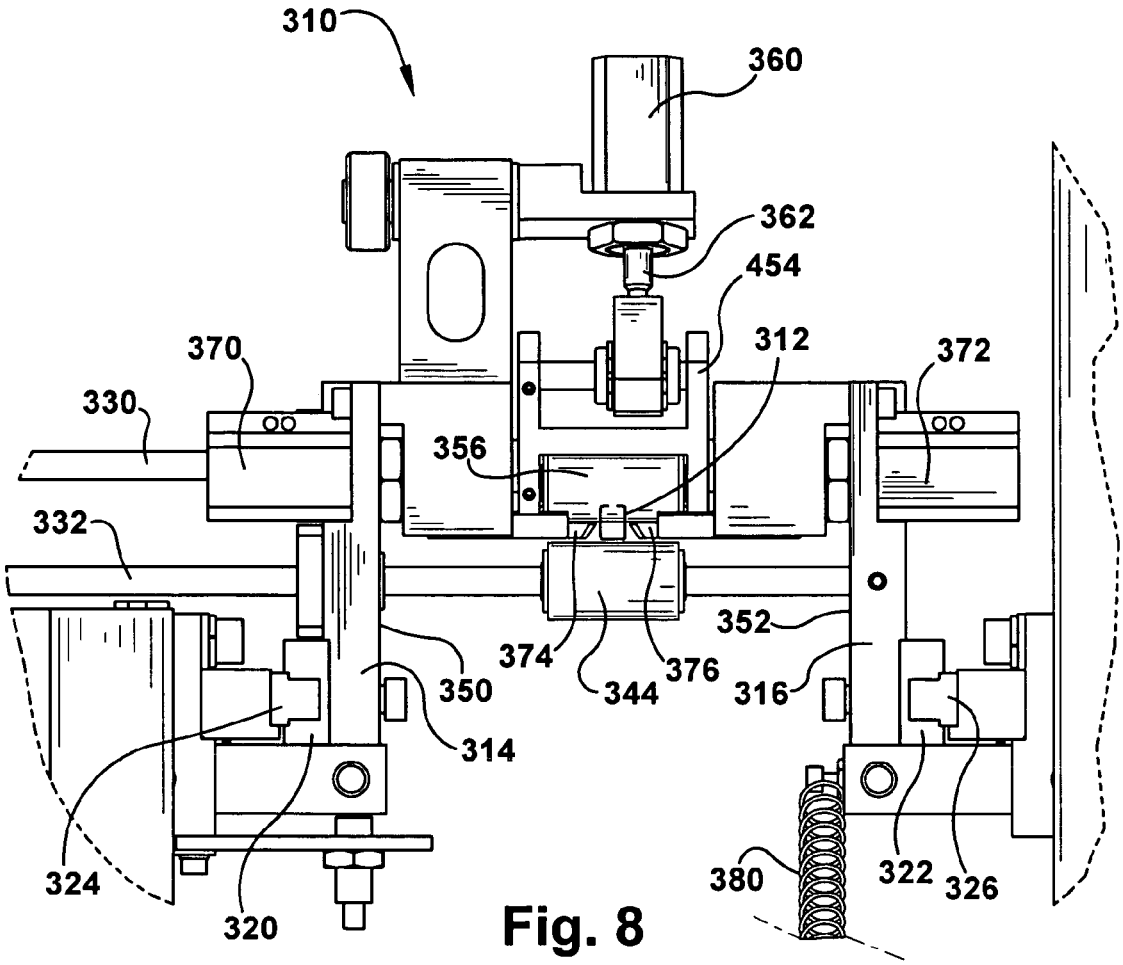
FIG. 8 is a front elevation view of the crimping assembly.
Figure 8A:
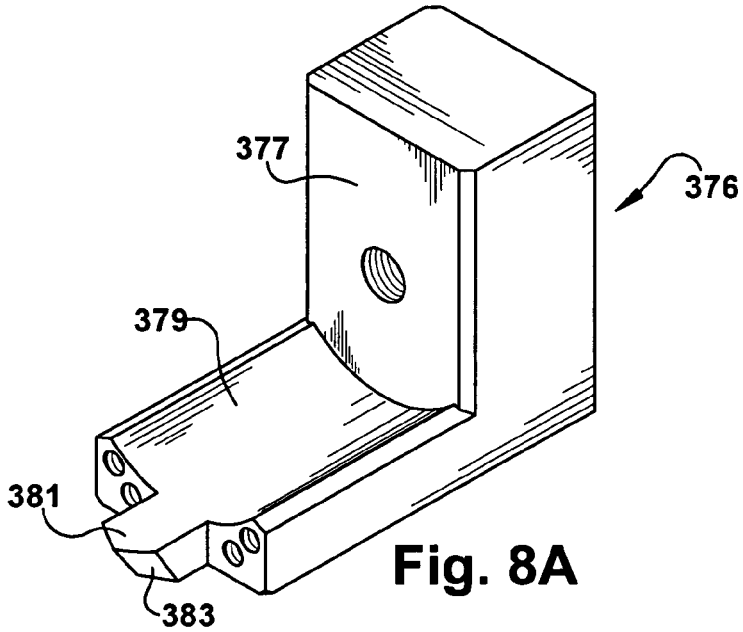

The exemplary crimper assembly 310 also includes two horizontally oriented pneumatically actuated cylinders 370, 372. Crimping fingers 374, 376 are attached to the output drive rods 378 of these cylinders. The crimping fingers 374, 376 are located so that their center line of action extends parallel to and intersections a region between the center lines of rotation of the rollers 344, 356. When the cylinders are extended the crimp fingers strike the corners or leads at their center. FIG. 8A is a perspective view of the crimping finger 376. A threaded opening in a mounting block 377 allows the finger 376 to attached to the output of the drive cylinder 372. A v-shaped contact 381 has a beveled underside 383 which extends from a U-shaped portion 379 of the finger 376. A top portion of the contact 381 comes into contact with the frame initially and continued movement of the finger brings the beveled underside into engagment with the frame to crease the frame in the region of weakness.

A long extension spring 380 attached to the carriage 316 ties one side of the crimp assembly to a fixture 381 on a lower rollformer. This spring returns the crimp assembly 310 to a start position S (See FIG. 12A) after a crimp operation. Two small shock absorbers 382 prevent bounce when the Crimp Assembly stops.

Pneumatic System 450

Figures 10, 11A, 11B:
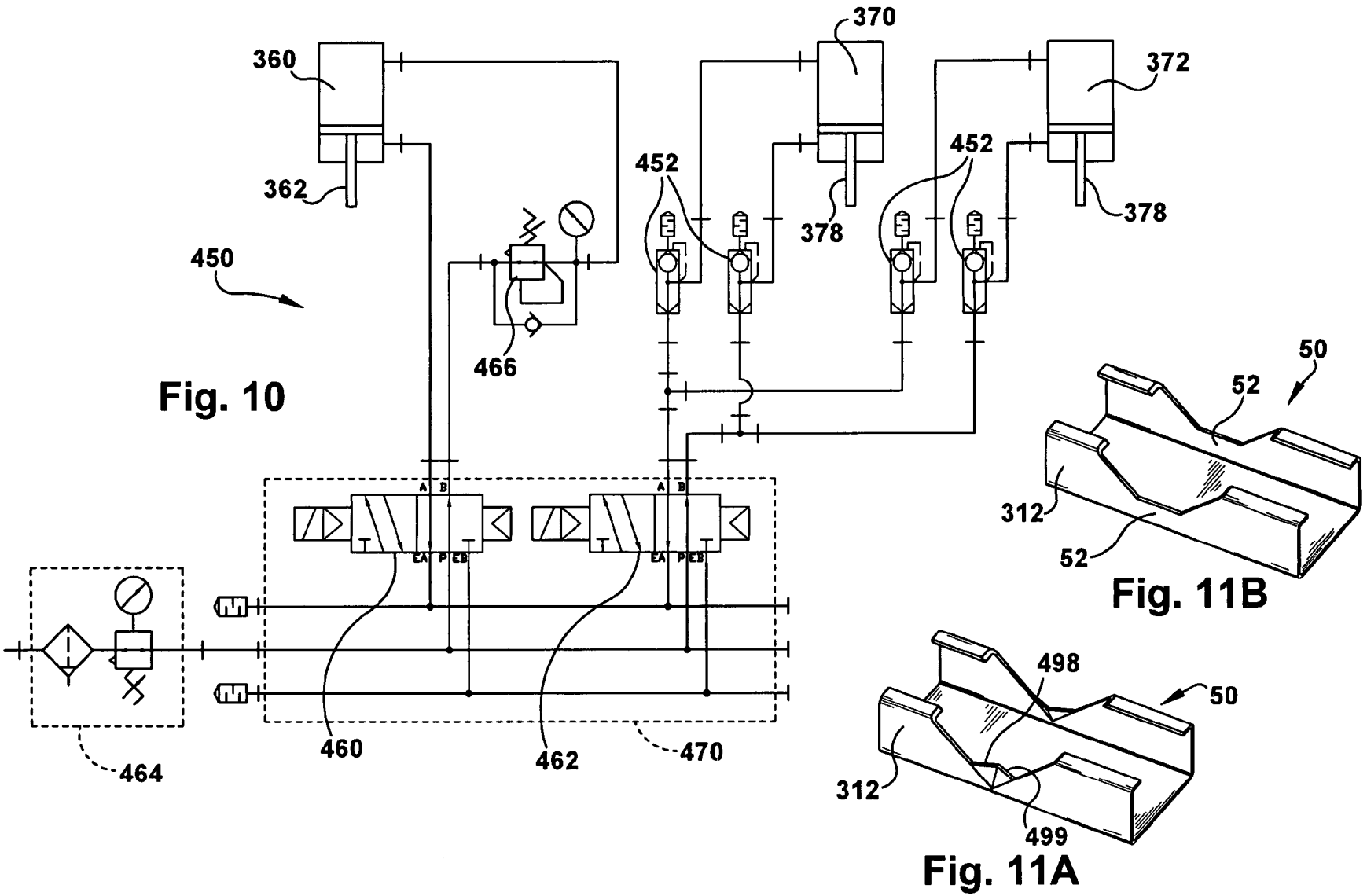
FIG. 10 is a pneumatic schematic for activing a drive for crimping the sides of a spacer frame.
FIGS. 11A and 11B are perspective views of a spacer frame, one having not been crimped and a second that has been crimped.

A pneumatic system 450 is depicted in FIG. 10. The pneumatic components consist of four exhausts 452 are located at the ports of the crimping cylinders 370, 372. They help to achieve maximum speed from the cylinders.

There are two solenoid valves 460, 462. One raises and lowers the top roller. The other activates the Crimping fingers.

There are two pressure regulators 464, 466. The first regulator determines the amount of pressure going into the manifold. This pressure regulates how hard the crimp cylinders pushes on the spacer. If this regulator is set too high it will break through the corners. If it is too low the corners will not be struck hard enough. 60 to 80 psi is the exemplary range for this regulator.

The second regulator 466 is a precision regulator. It is mounted at the top of the print arm support extrusion. This regulator determines how much pressure is applied to the top roller 356 by the cylinder 360. It is set properly when the roller locks into the corners and leads and the crimp is in the correct location. It is preferable when adjusting this regulator to start from the low end and increase the pressure until the desired results occur. If the crimper engages too early on the leads, the pressure is too high. If the crimps are late, the pressure is too low.

Figure 9:
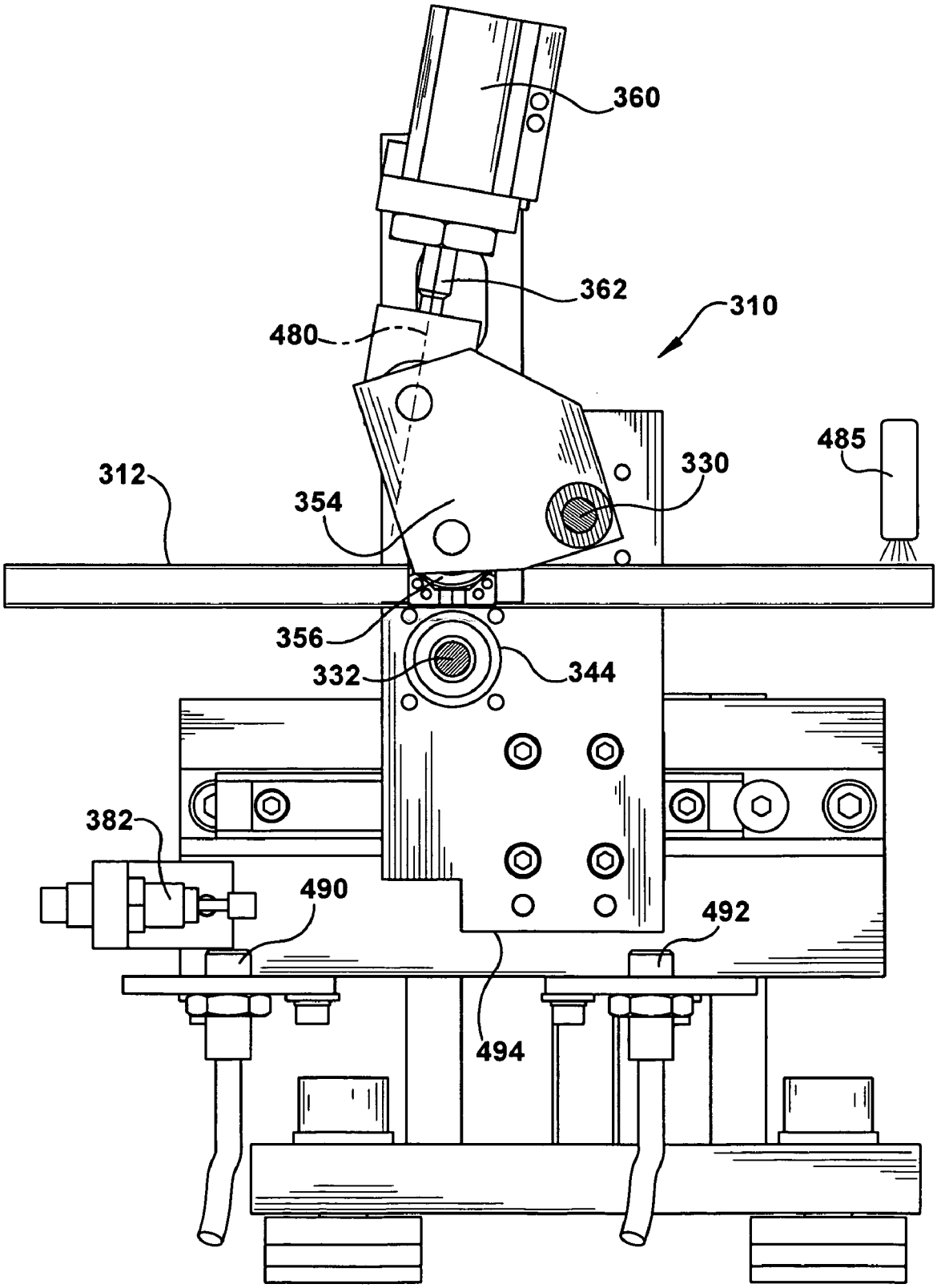
FIG. 9 is a side elevation view of the crimping assembly.

FIG. 9 illustrates a line of force 480 that is applied to a point on the yoke wherein a output from the cylinder 360 is pinned to the yoke 354. A force against this point exerts a moment about the pivot point of the yoke defined by the axis of rotation of the rod 330 which in turn results in a controlled downward force of engagement between the top roller 356 and the spacer frame 312. By controlling the pressure applied to the cylinder this force of engagement can be adjusted to achieve proper crimping action.

Sensor Components

When an ON/OFF switch (not shown) is set to the ON position power is supplied to the crimper assembly. After power is turned on the crimper fingers are disabled until there is material threaded through the roll former. A photoeye 485 located near spacer frame 312 the points downward. This photoeye 485 enables the crimper assembly once Material is present. If no Material is present the crimper fingers will not operate. The photoeye 485 facilitates initial material thread up (loading) through the crimper assembly without risk that the crimper fingers will be actuated.

At the bottom of the crimper assembly on one side there are two proximity sensor switches. They are named MIN and MAX. The MIN switch 490 is the switch that is covered by a bottom surface 494 of the side plate 314 when the Crimper Assembly is not engaged with the spacer frame. The MAX proximity switch 492 is near the end of the travel when the Crimper Assembly is engaged with the spacer frame.

Relays (not shown) which are actuated under the control of the controller 122 are used to control the actions of the crimper fingers.

Operation

When the top roller engages into a corner or lead the movement of the spacer frame drags the Crimper Assembly off of the MIN proximity switch. When the MIN switch is lost it causes the Crimper fingers to extend.

When the Crimper Assembly triggers the MAX limit switch the Roller and Crimper fingers retract so that they are no longer touching the spacer. Once they are retracted the Crimper Assembly returns to the MIN switch position.

Figure 12A:
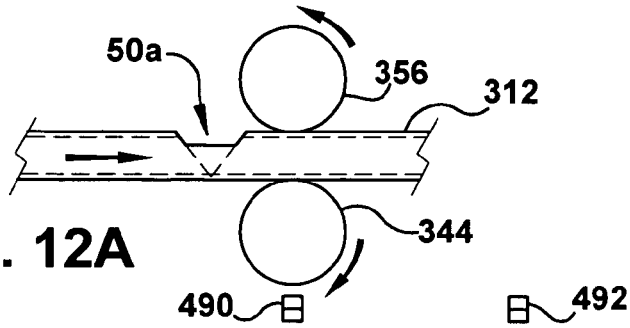
FIGS. 12A, 12B, 12C, 12D and 12E schematically depict different stages of the movement of the crimping assembly.
Figure 12B:
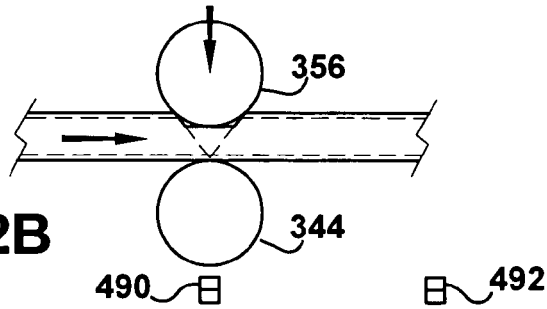
Figure 12C:
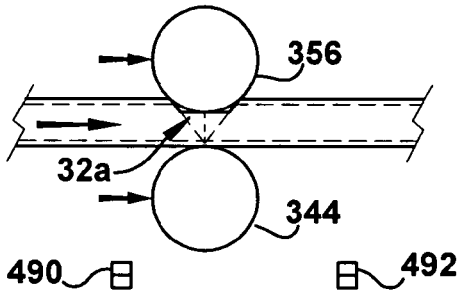
Figure 12D:
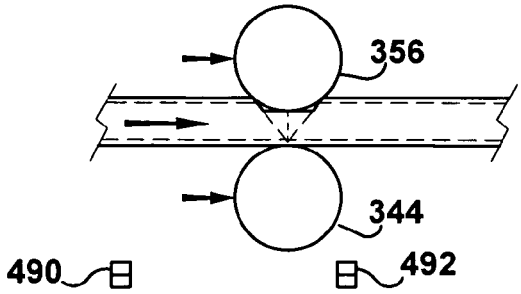
Figure 12E:
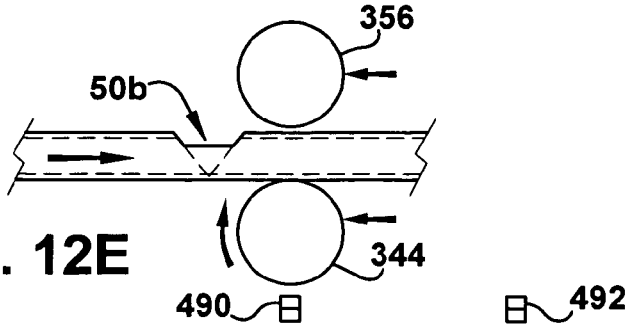

FIGS. 12A-121E illustrate one sequence of positions of the rollers 344, 356 as a crimp operation is performed. As depicted in FIG. 12A when the process of crimping begins the upper roller 356 rides on or engages the flanged surface of the frame 312 as the frame exits the roll former. A downward pressure is exerted against the roller 356 due to the output of the pneumatic cylinder 360. as the frame continues to move, a notch 50*a* reaches the position of the crimping fingers where the roller 356 is pushed into the notch to couple the crimping assembly for movement with the frame 312. At the position 12C the crimping fingers are extended and contact the region of weakness 52 of the notch 50*a*. This bends the region inward from the sides into a channel formed by the spacer frame. (See FIG. 11A) The resulting region of weakness has two generally triangular shaped portions 498, 499 with a center crease extending from a base wall of the frame to a center of the region of weakness 52. The movement continues as the crimping fingers retract and the sensor switch 492 senses the arrival of the bottom surface of the carriage. This causes the solenoid actuator 360 to release the upper roller from its engagement with the frame to a position spaced above the frame (FIG. 12E) and the spring is then able to pull back the crimper assembly to the position shown in FIG. 12E to await the next subsequent notch 50*b* in the spacer frame. Although two sucessive notches are shown in the sequence depicted in FIG. 12A-12E, it is appreciated that a lead in portion of the frame could also be encountered and crimped.

During operation of the fingers, a crimp pressure is initially set to be at least 60 psi and a maximum pressure is set to 85 psi. A roller down pressure is set to a minimum starting pressure of 0.10 Mpa and a maximum pressure of 0.25 Mpa.

While an exemplary embodiment of the invention has been described with particularity, it is the intent that the invention include all modifications from the exemplary embodiment falling within the spirit or scope of the appended claims.

The invention claimed is:

1. Apparatus for fabricating a spacer frame for use in an insulating glass unit comprising:

a) forming structure for forming a spacer frame having side walls which exits the forming structure moving along a path of travel and to which an adhesive is applied during fabrication of an insulated glass unit;

b) a notching apparatus for forming notches at locations that extend into the side walls to weaken said side walls for bending of said spacer frame into a closed structure; and c) a workstation comprising i) crimping fingers that are moved into contact with said side walls to bend the spacer frame, side walls inwardly toward each other at a region of the notches, and ii) a carriage supporting the crimping fingers which intermittently moves with the spacer frame along its path of travel as the crimping fingers are brought into contact with side walls of the spacer frame.

2. The apparatus of claim 1 wherein the spacer frame is metal and the forming structure is a roll former having multiple rolls which contact a metal strip fed to the roll former.

3. The apparatus of claim 2 wherein the notching apparatus is located ahead of the roll former to form notches in the metal strip prior to bending by the roll former.

4. The apparatus of claim 1 wherein the carriage comprises first and second carriage portions are separatated by a space between the carriage portions where the crimping fingers contact the sides of the channel and wherein the spacing between carriages is adjustable to accommodate different width frames.

5. The apparatus of claim 1 wherein contact rollers contact a top and a bottom surface of the spacer frame and wherein one of said rollers is supported by a yoke that allows the one roller to pivot into a notch in the frame as the frame moves past the crimping station.

6. The apparatus of claim 5 wherein the one roller that pivots into the notch frictionally engages edges of the frame that define the notch and moves the crimping fingers along a travel path with the frame as the crimping fingers engage an outer wall of the frame.

7. The apparatus of claim 6 additionally comprising a drive for selectively applying a pressure to the the one roller to maintain engagement between said one roller and the frame as the crimping fingers engage the outer wall of the spacer frame.

8. A method for use in fabricating a spacer frame for using in making an insulating glass unit comprising:

a) forming notches in a metal strip at corner locations;

b) bending the metal strip into a channel shaped elongated frame member;

c) mounting a carriage for intermittent movement with the elongated frame member as the elongated frame member moves along a travel path subsequent to the bending; and d) supporting crimping fingers with the carriage and moving the fingers into contact with sides of the channel shaped elongated frame member at the region of the corner defining notches to bend the channel inwardly to facilitate further bending of the frame into a closed structure.

9. The method of claim 8 wherein different channel widths of the frame member are accomodated by adjusting a spacing between the crimping fingers supported by the carriage in an actuated and unactuated position.

10. The method of claim 8 wherein the carriage supports a pair of spaced rollers which contact the frame member as the crimping fingers engage the frame member and wherein further comprising adjusting a pressure applied to one of said rollers to maintain engagement between said roller and said channel.

11. The method of claim 10 wherein the roller is biased by a drive and further wherein the drive operation is controlled by a sensor which senses movement of the carriage as the crimping fingers engage the frame.

* * * * *